US005791384A

United States Patent [19]

Evans

[11] Patent Number: 5,791,384

[45] Date of Patent: Aug. 11, 1998

[54] METHOD, MACHINE AND DIAGONAL PATTERN FABRIC FOR THREE-DIMENSIONAL FLAT PANEL FABRIC

[76] Inventor: Rowland G. Evans, 1320 Independence Ave., SE., Washington, D.C. 20003

[21] Appl. No.: 697,496

[22] Filed: Aug. 26, 1996

Related U.S. Application Data

[60] Provisional application No. 60/002,840, Aug. 28, 1995.

[51] Int. Cl.[6] ..... D03D 1/00

[52] U.S. Cl. ..... 139/383 R; 139/11; 139/DIG. 1; 442/205

[58] Field of Search ..... 139/383 R, 14, 139/11, DIG. 1; 66/11

[56] References Cited

U.S. PATENT DOCUMENTS

| | | | |
|---|---|---|---|
| 3,749,138 | 7/1973 | Rheaume et al. | 139/DIG. 1 |
| 4,492,096 | 1/1985 | Cahuzac | 139/14 |
| 5,137,058 | 8/1992 | Anahara et al. | 139/DIG. 1 |
| 5,224,519 | 7/1993 | Farley | 139/DIG. 1 |
| 5,242,768 | 9/1993 | Nagatsuka et al. | 139/DIG. 1 |
| 5,465,760 | 11/1995 | Mohammed et al. | 139/DIG. 1 |

*Primary Examiner*—Andy Falik

[57] ABSTRACT

A method and machine for rapidly manufacturing transverse diagonal three dimensional fabric in flat panels of variable thicknesses and cross sections, wide widths and continuous length consisting of a yarn guide plate that holds all longitudinal yarns in exact position, two rows of knitting needles, or sewing needles with loopers, that insert rows of transverse yarns at +45° and −45° in the transverse plane, a beat mechanism that moves the yarn guide plate to compact the transverse yarns, and a shift mechanism that moves both rows of needles alternately one row to the right and to the left to bind the right and left side edges of the fabric. A three-dimensional fabric pattern that is produced by this method and machines, which consists of multiple rows of longitudinal yarns held straight in the longitudinal plane, aligned exactly with the longitudinal axis, multiple rows of straight transverse diagonal yarns alternating at +45° and −45° in the transverse plane orthogonal to themselves and to the longitudinal yarns, chained loop stitches of transverse yarns at the bottom edge of the fabric, which has the right and left side edges of the fabric bound with transverse yarns.

5 Claims, 4 Drawing Sheets

METHOD, MACHINE AND DIAGONAL PATTERN FABRIC FOR THREE-DIMENSIONAL FLAT PANEL FABRIC

EARLIER APPLICATION

Provisional application Ser. No. 60/002,840 was filed on 28 Aug. 1995.

BACKGROUND OF THE INVENTION

Field of Invention

This invention pertains to three-dimensional fabric and in particular to a three-dimensional fabric in a transverse diagonal pattern rapidly produced in flat panels of variable thicknesses, variable cross sections, wide widths and continuous length, and to the methods and machines to produce the same.

Description of the Prior Art

Three-dimensional fabric structures are primarily useful as the reinforcing material for a range of composite materials in which plastic resins or ceramics are used to impregnate the fabric material which is then molded and cured into composite products having commercially useful physical properties.

The three basic different fabric manufacturing techniques, e.g. weaving, braiding and knitting, have all been previously used to produce three-dimensional fabric. Each of the implementations have limitations and fundamental differences from this invention.

In the field of weaving, Fukuta, U.S. Pat. No. 3,834,424, disclosed the basic patent for weaving three-dimensional orthogonal fabric. The fabric produced has yarns that are straight and orthogonal at 90° in each of the X, Y, and Z axis. U.S. Pat. Nos. 4,526,026 and 5,085,252 disclose enhancements to Fukuta's method and fabric. An inherent limitation of these machines is slow weaving speed. Further, the weaving speed is proportionally reduced as fabric width is increased. Also, practical fabric width is limited with these machines.

U.S. Pat. Nos. 5,137,058; 5,224,519 and 5,465,760 disclose different methods of inserting paired rows or sheets of bias yarns in the longitudinal plane between the respective rows or sheets of longitudinal yarns in a conventional X, Y, Z three-dimensional fabric. In the first of these the bias angles are at +45° and −45° and, in the other two of these, the bias angles can be varied 20°–60°. However, all of the bias angles are in the longitudinal plane for the purpose of improving strength in the bias directions. In all of these, the rows of bias yarns are in addition to the three planes of yarns found in a conventional X, Y, Z three-dimensional fabric which are retained intact as a core part of these bias fabrics. These machines are also inherently very slow, the speeds are proportionally reduced as fabric width is increased and they are limited in the practical width of fabric that they can produce.

U.S. Pat. Nos. 4,031,922; 4,046,173; 4,066,104; 4,140,156 and 4,438,173 disclose several different methods for triaxial weaving. Triaxial woven fabric is not a true three-dimensional fabric because it is a single layer of fabric, not a multilayer fabric. The fabric produced also has the major limitation that the yarns are heavily crimped and are not orthogonal to each other.

U.S. Pat. Nos. 3,749,138; 3,904,464; 3,993,817; 4,001,478 and 4,080,915 disclose methods for weaving hollow cylindrical fabric structures. These machines are not capable of producing flat panels of fabric.

In the field of braiding, Fukuta, U.S. Pat. No. 4,615,256 discloses a method and apparatus for braiding three-dimensional fabric. Although the title of this invention is "woven fabric", this is a misnomer. This is actually a braiding process in which rotating yarn carriers intertwine transverse yarns around straight longitudinal yarns. Thus the transverse yarns are not straight or orthogonal. The fabric cross sections are a variety of rectangles and hollow cylinders of limited widths; not wide flat panels. The machine is also inherently slow and the speed is proportionally reduced as fabric width is increased.

In the field of knitting, Banos, U.S. Pat. No. 4,183,232 and Cahuzac, U.S. Pat. No. 4,492,096 invented successively improved methods and machines to knit hollow cylindrical fabric structures. These structures contain straight longitudinal yarns that are not continuous but limited to the height of the machine, e.g. two meters or less. The transverse plane of yarns is inserted in a spiral or helical layer. That is, the knitting needles knit incrementally around the circumference of the cylinder continuously inserting radial (transverse) yarns. They advance in the longitudinal direction by the distance of one layer of radial (transverse) yarn for every revolution of the cylinder past the knitting head. These machines are extremely slow and cannot produce flat panels of fabric.

However, it is noted that the diagonal pattern of the yarns in Cahuzac's fabric is superficially similar to this invention transverse diagonal fabric pattern. An examination of Cahuzac's fabric reveals several fundamental differences with this invention. Cahuzac's fabric is a closed cylindrical form, not flat; the transverse yarns are curved, not straight; loops in the chained loop stitches do not chain with the prior row of knit; and, since it is a closed cylinder of fabric without side edges, there is no capability of binding side edges.

A copending application Ser. No. 08/707,671, allowed Aug. 1997 titled "Method and Machine for Transverse Diagonal Three-Dimensional Fabric with Longitudinal Wires" has also been submitted. The copending application utilizes the same transverse diagonal three-dimensional fabric pattern disclosed in this invention but substitutes stiff wires as the longitudinal fibers. Stiff wires refer to monofilament or single strand wires that cannot be elastically deformed very much in either the longitudinal or radial dimension; that is they take a permanent bend or dent with large deformation Therefore, such stiff wires must be spread apart sufficiently to permit the needles to pass between them to insert the transverse diagonal yarns. The stiff wires must then be compressed together and the transverse diagonal yams tightened around them to complete the fabric. The copending application discloses a method and a machine to perform these functions which are in addition to the actions performed by the machines in this invention.

OBJECT AND SUMMARY OF THE INVENTION

The major object of this invention method and machine is to produce transverse diagonal pattern three-dimensional fabric in flat panels of variable thicknesses and cross sections in widths of several feet at speeds at least ten times faster than current machines. This invention machine has very short motions of all components, and therefore it is inherently much faster, and thus produces fabric at lower cost, than three-dimensional weaving looms which are currently the only machines capable of producing flat panels of three-dimensional fabric. Additional objectives are that speed not be reduced as fabric width increases and that there be no restrictions on the practical width of the machine.

The principal objective of this invention transverse diagonal three-dimensional fabric pattern is to produce rows of straight longitudinal yarns in the longitudinal plane aligned exactly with the longitudinal axis, intimately supported by straight transverse yarns at angles of +45° and −45° in the transverse plane orthogonal to each other and the longitudinal yarns. Another objective of this fabric pattern is that it facilitate rapid production in continuous lengths, wide widths and variable thicknesses and cross sections.

The objectives of the method, machine and fabric pattern all support low cost production of a three-dimensional fabric that can be used in low cost composite structures with superior performance capabilities in the longitudinal direction.

The summary of the method of this invention is to use a hybrid of both knitting and weaving techniques to produce a transverse diagonal pattern three-dimensional fabric specifically designed to support very rapid production of flat panels of variable thicknesses and cross sections in wide widths and continuous length.

The summary of this invention machine is that it is a hybrid knitting/weaving loom consisting of the following major components which perform the described functions. First a yarn guide plate holds multiple rows or sheets of longitudinal yarns in the longitudinal plane arranged in the transverse diagonal pattern. Next, two rows of knitting needles, or alternatively two rows of sewing needles with accompanying loopers, insert rows of straight transverse yarn in the transverse plane at angles of +45° and −45° between the longitudinal yarns. A beat mechanism then moves the yarn guide plate forward to compact each successive row of +45° and −45° transverse yarns against the fell of the completed fabric. After each pair of rows of transverse yarns at +45° and −45° is beat up, both rows of retracted needle bars are moved one yarn space to the right or alternately to the left. This causes successive rows of transverse yarns to bind the left and right side edges of the fabric.

The summary of this invention fabric pattern is that it is a three-dimensional fabric consisting of multiple rows or sheets of longitudinal yarns which are held straight in the longitudinal plane aligned exactly with the longitudinal axis and multiple rows of straight transverse yarns alternating at +45° and −45° in the transverse plane orthogonal to themselves and to the longitudinal yarns and interlaid between them forming a dense interlocked fabric. Chained loop stitches at the bottom edge of the fabric chain each row of transverse yarns to the preceding row. The transverse yarns also pass around the exterior of the left most and right most longitudinal yarns to bind the left and right side edges of the fabric. The fabric can be produced in variable thickness and variable cross section shape.

DETAILED DESCRIPTION OF THE INVENTION

The inventive method and machine for making three-dimensional fabric and the inventive transverse diagonal fabric pattern shall now be described.

It should be understood that the terms "up, down, right, left, top, bottom" and so on, shall be used only for the sake of clarity and that this invention apparatus may operate in various other orientations.

It should be understood that X, Y, and Z refer to the X, Y, Z axis in a conventional orthogonal Cartesian coordinate system in which the X axis is oriented in the longitudinal or warp output direction, the Y axis is oriented in the transverse or weft direction and the Z axis is oriented in the vertical upward or thickness direction. The X plane or longitudinal plane is defined as containing the X and Y axes, the Y plane or transverse plane is defined as containing the Y and Z axes and the Z plane or thickness plane is defined as containing the X and Z axes. This notation system is used for the sake of clarity and other notation systems may be used within the scope of this invention.

It should also be understood that the term "yarn" is used only for the sake of clarity and that this invention specifically includes the capability for this machine to use yarns (twisted fiber bundles); tows (untwisted fiber bundles); threads (multiple yarns twisted together); and flexible multistrand fine wires, twisted or not. This machine cannot use stiff monofiliments or stiff single strand wire.

This invention specifically includes the capability to utilize a variety of different fiber materials including a mix of different fibers in the same piece of the invention fabric. The different types of fiber material include but are not limited to organic material fibers such as wool, cotton, linen and others; synthetic fibers such as polyester, polyaramid, polypropylene and others; inorganic fibers such as glass, carbon, asbestos and others; and flexible multistrand fine metal wires such as stainless steel, aluminum and others.

The machine consists of a hybrid of knitting and weaving techniques. There are two alternative embodiments of the machine; embodiment 1 utilizing knitting needles to insert the transverse yarns in the fabric; and embodiment 2 utilizing sewing needles and accompanying loopers to insert the transverse yarns in the fabric. Embodiment 1 shall now be described.

EMBODIMENT 1

Figure 1:
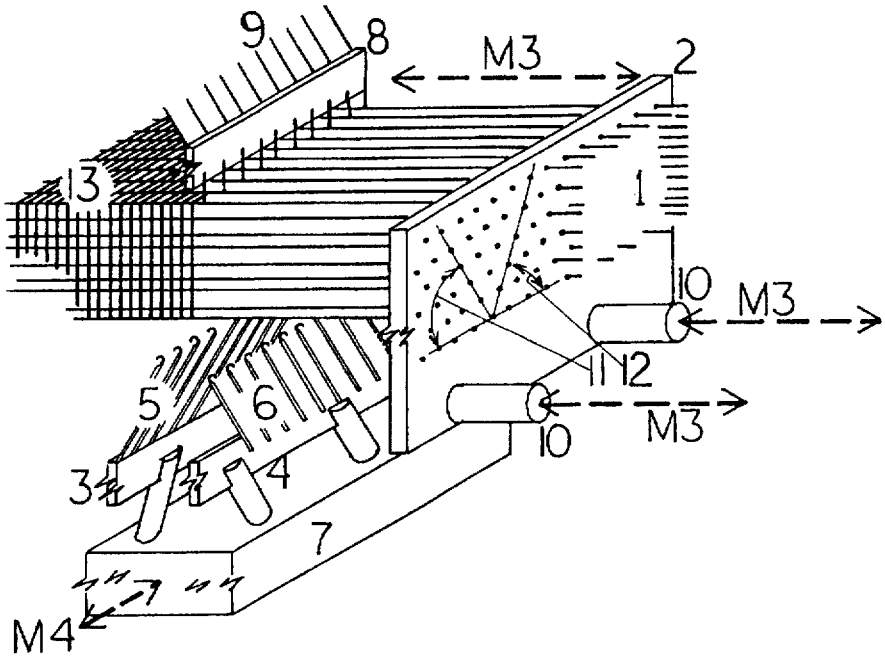
FIG. 1 is a general schematic arrangement of the principal components the of the machine to produce transverse diagonal three-dimensional fabric implemented with knitting needles. It is shown in cut-away and partially exploded perspective for clarity.

The first element of the machine described is the longitudinal yarn guide plate 2 in FIG. 1. Longitudinal yarns 1 are fed from a creel or beam into an array of holes in the yarn guide plate 2. The holes are arranged accurately in multiple rows in the longitudinal plane and the spacing of the holes is arranged in the diagonal pattern of the fabric at +45° 12 and −45° 11. The hole diameters and spacing must be designed to suit a particular range of yarn diameters and yarn spacing desired in the fabric. Various of the holes may be left empty to achieve smaller width, thicknesses and cross section shapes in the fabric as desired. It should be emphasized that other techniques than a perforated plate design for the yarn guide are possible and within the scope of the invention including a diagonal cross matrix of wires or reeds.

Figure 3A:
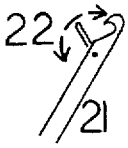
FIGS. 3A through 3E depict in detail the sequence of operations of the knitting needles, needle bars and needle bar shift mechanism.
Figure 3B:
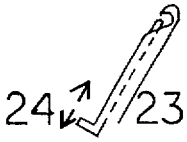
Figure 3C:
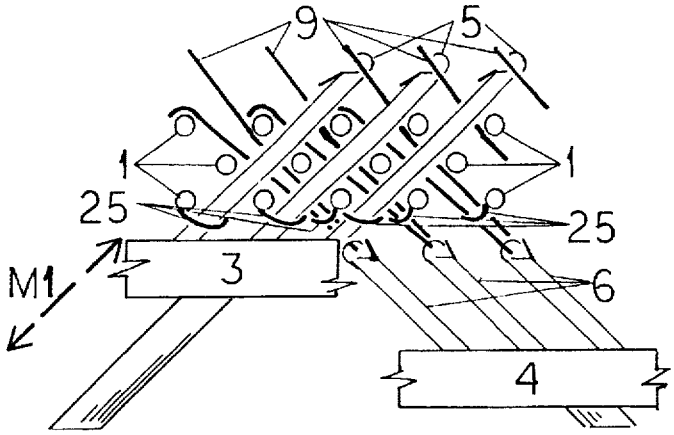
Figure 3D:
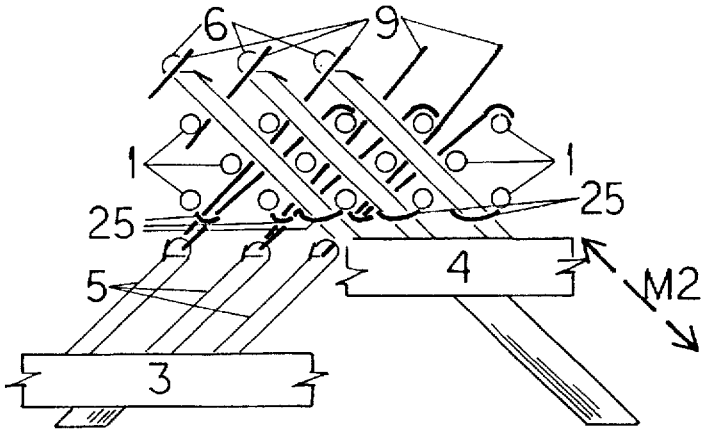
Figure 3E:
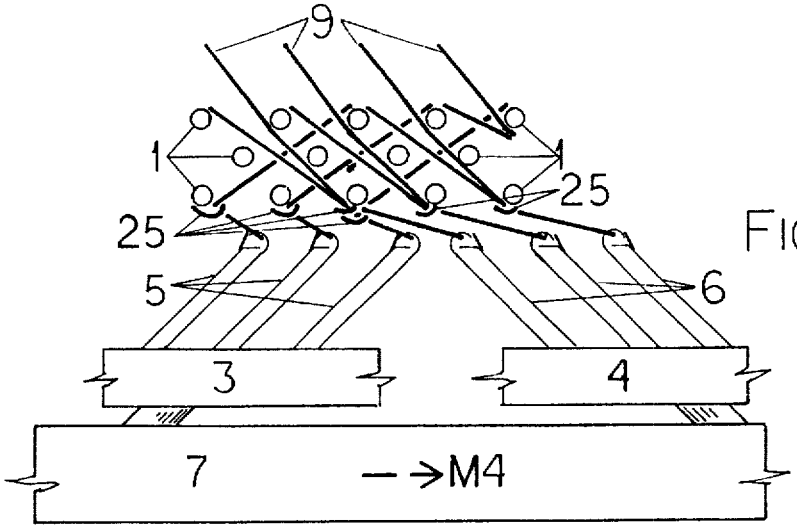

The next elements described are two rows of knitting needles 5,6 as shown in FIG. 1 and also in FIGS. 3C, 3D and 3E. They are mounted in two needle bars 3,4. One row of needles is mounted at +45° to the vertical 5 and the other row at −45° to the vertical 6.

A variety of different types of knitting needles are known to the art and several of them may be used in the practice of this invention. What is new to the art is the use of conventional knitting needles, in conjunction with the other components described in this invention, to produce transverse diagonal three-dimensional fabric at high speeds. For the purpose of illustration, a latch type knitting needle 21 is shown in FIG. 3A in which the closing element 22 is opened and closed as the needle passes up or down through other yarns or loops of yarns. A compound type knitting needle 23 is shown in FIG. 3B in which the closing element 24 is actuated mechanically. Either type may be used in the practice of this invention.

The stroke motions M1, M2 are now described as shown in FIGS. 3C and 3D The +45° row of needles 5 are driven upward M1 by their needle bar 3 through the old yarn loops of their last stroke 25 and up through +45° corridors 12 (shown in FIG. 1) between the longitudinal yarns 1. At the top of its stroke, each needle catches a new transverse yarn 9 fed from a conventional yarn guide 8. The needle bar 3 now retracts M1 the row of needles 5 and each needle pulls a new loop of transverse yarn 9 down through its corridor between the longitudinal yarns 1 as shown in FIG. 3D. At the bottom of the stroke, the needles 5 pull the new loops down, clear through the old loops 25 forming chained loop stitches at the bottom edge of the fabric. Thus the new row of transverse yarns is chained to the preceding row of transverse yarns by their old loops.

Next, as shown in FIG. 3D, the −45° needles 6 are driven upward M2 by their needle bar 4 and catch transverse yarns 9 at the top of their stroke. The −45° needles 6 are then retracted M2, pulling new loops of transverse yarn 9 down through −450 corridors 11 (shown in FIG. 1) in the longitudinal yarns 1. At the bottom of their stroke they also pull their new loops through their old loops 25, also forming chained loop stitches at the bottom edge of the fabric as shown in FIG. 3E.

The needle size, length and spacing may be varied depending on the diameter of the transverse yarn, the designed thickness of the fabric and the designed spacing of the transverse yarns.

The maximum thickness of the fabric that can be produced is constrained by the length of the needles. Practical needles can be obtained a few inches in length which, in turn, can be used to produce fabric a few inches thick.

The maximum speed of the machine is constrained by the maximum speed of the needle bars. Since the needles travel only through the thickness of the fabric, needle stroke is inherently short and can be made to operate very rapidly. Hence, the speed of the machine is inherently high.

The next element described is a beat mechanism 10 shown in Figure 1 that moves the yarn guide plate 2 forward to compact the transverse yarns against the fell of the completed fabric 13 and then retracts. This motion is shown as M3 in FIG. 1. Thus, the yarn guide plate is also used to perform a second function, e.g. compacting the transverse yarns. It must be understood that a variety of actuator mechanisms are possible and within the scope of the invention including a push rod mechanism shown here.

The next element described is a shift mechanism 7 shown in FIG. 1 to shift both needle bars one yarn space to the right, or alternately, to the left. This alternate shift is shown as M4 in FIG. 1 and also in FIG. 3E. It is done after both needle bars complete their strokes as also shown in FIG. 3E. This shift M4 of the needle bars aligns each needle with the next adjacent right or left yarn corridor in preparation for the next stroke. On the next stroke the outer most right needles of both rows of needles 5,6 or alternately, the outermost left needles, stroke to the right, or alternately left, of the outer most longitudinal yarns i.e. the right and left side edge longitudinal yarns. Thus, this alternating shift M4 of both needle bars 3,4 causes transverse yarns to alternately pass around the outer longitudinal yarns binding the right and left side edges of the fabric.

It is noted that the top edge of the fabric was bound when each row of needles 5,6 caught a new transverse yarn at the top of the stroke and then pulled the yarn down over the top row of longitudinal yarns 1 which can best be seen in FIG. 3E at the top edge of the fabric.

A variety of take-up devices are known to the art, any of which may be used in the practice of this invention to pull the completed fabric 13 from the machine. These include but are not limited to take-up rolls, a synchronized stepper motor driving a clamping puller and a variety of take-up drum designs.

A variety of actuation devices are known to the art, any of which may be used in the practice of this invention which include but are not limited to pneumatic, hydraulic, electric or mechanical actuators and linkages or combinations of these.

A variety of loom control devices are known to the art, any of which may be used in the practice of this invention which include but are not limited to manual, electrical, electronic, or computer control or a combination of these.

The maximum width of fabric that can be produced is constrained by the design width of the instant machine. There are no inherent limits on the width to which this machine can be designed and therefore practical machines several feet in width can be produced within the scope of this invention. Thus, transverse diagonal fabric several feet in width can be produced within the scope of this invention.

EMBODIMENT 2

The second embodiment of this invention uses sewing needles and loopers in conjunction with other components to produce this invention transverse diagonal three-dimensional fabric. Embodiment 2 shall now be described in detail.

Figure 2:
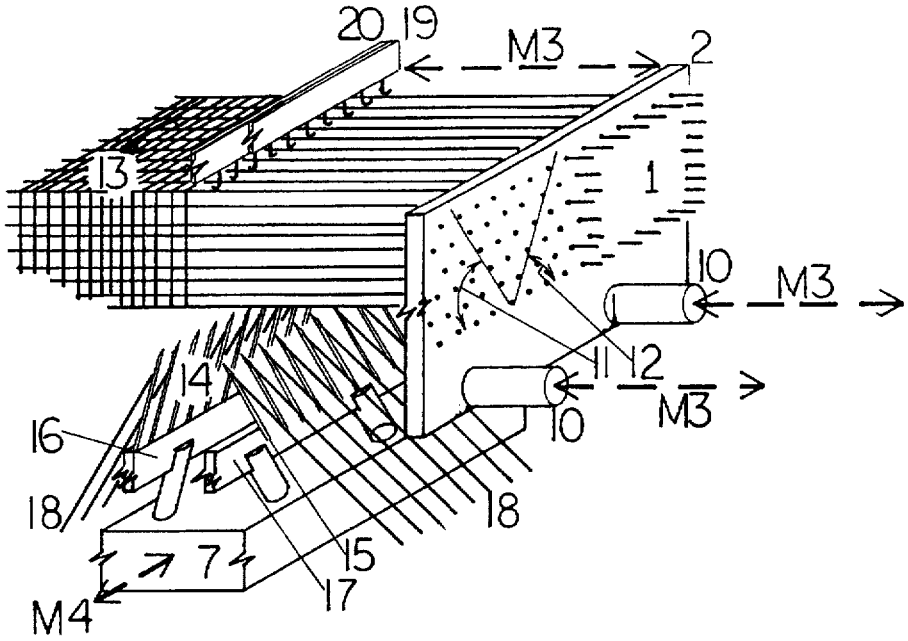
FIG. 2 is a general schematic arrangement of the principal components of an alternative machine to produce diagonal three-dimensional fabric implemented with sewing needles and loopers. It is also shown in cut-away and partially exploded perspective for clarity.

The first element of the machine described is the longitudinal yarn guide plate 2 in FIG. 2. It is identical in configuration and function as the longitudinal yarn guide plate described in Embodiment 1.

The next elements described are two rows of sewing needles 14,15 mounted in needle bars 16,17 and their accompanying loopers 19,20 shown in FIG. 2 and also in FIGS. 4A through 4E. A variety of sewing needles and loopers are known to the art and may be used in the practice of this invention if configured in appropriate size and shape.

What is new to the art is the use of conventional sewing needles and loopers, in conjunction with other components described in this invention, to produce transverse diagonal three-dimensional fabric at high speeds.

The sewing needles 14,15 shown in FIG. 2 have transverse yarns 18 that are fed upward from below the needle bars 16,17 and threaded through the eyes of the needles. The position of the transverse yarns, needles, eyes of the needles and needle bars are shown in FIG. 2; and in more detail, in FIGS. 4A–E.

The +45° needles 14 stroke motions M7,M8, the –45° needles 15 stroke motions M5,M6, the accompanying front looper 19 motions M9, M10, and the rear looper 20 motions M11,M12 will now be described as shown in FIGS. 4A–E.

Figure 4A:
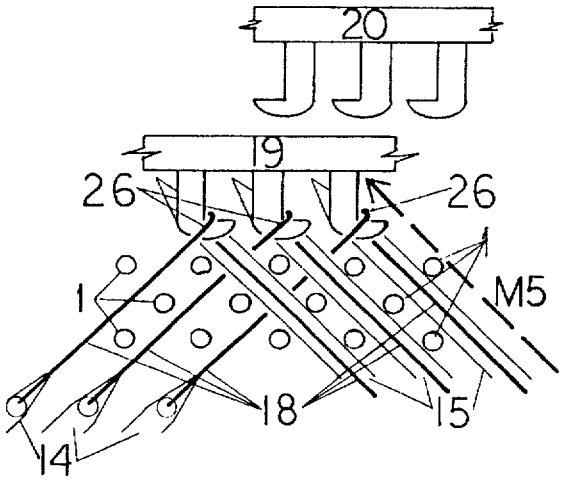
FIGS. 4A through 4E depict in detail the sequence of operations of the sewing needles, the loopers, the needle bars and needle bar shift mechanism in the alternate embodiment of this invention.

As each row of needles 14,15 is stroked upward M5,M7 at +45° or –45°, the transverse yarns 18 are pulled upward through the diagonal yarn corridors 11,12 (shown in FIG. 2) between the longitudinal yarns 1. FIG. 4A shows the –45° needles 15 driven upward M5 through the longitudinal yarns 1 and also through the old loops 26 held by the front looper 19. FIG. 4C shows the +45° needles 14 driven upward M7 through the longitudinal yarns 1 and also through the old loops 26 held by the rear looper 20.

Next, the loopers 19,20 move M9,M1O to release the old loops 26. This is followed immediately by the opposite loopers 20,19 moving M11,M10 to catch the new loops of transverse yarn 18 that are held in the eyes of the needles 14,15.

Figure 4B:
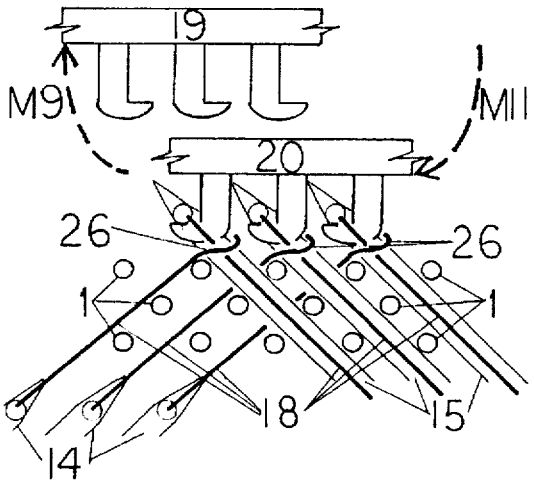
Figure 4C:
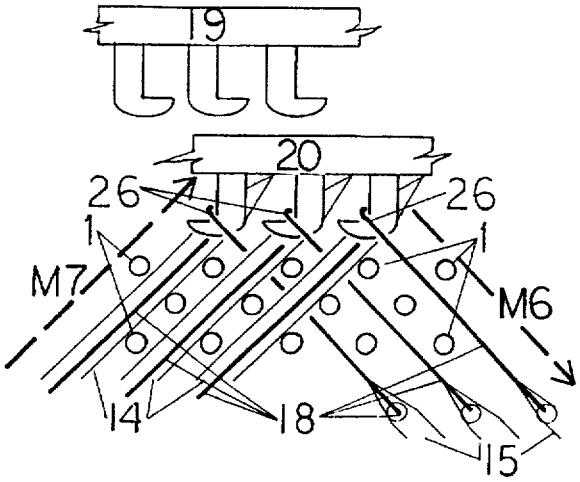

Specifically, FIG. 4B shows at the top of the stroke M5 of the –45° needles 15, the front looper 19 retracting M9, releasing the old loops 26, which then encircle both the shanks of the needles 15 and the new loops of transverse yarn 18 held in the eyes of these needles 15. Next, the rear looper 20 extends M11 to catch each new loop of transverse yarn 18 held in the eye of each needle 15. Then, FIG. 4C shows the rear looper 20, holding the "caught"loops 26 while the –45° needles retract M6. The "caught" loops now become "old" loops.

Figure 4D:
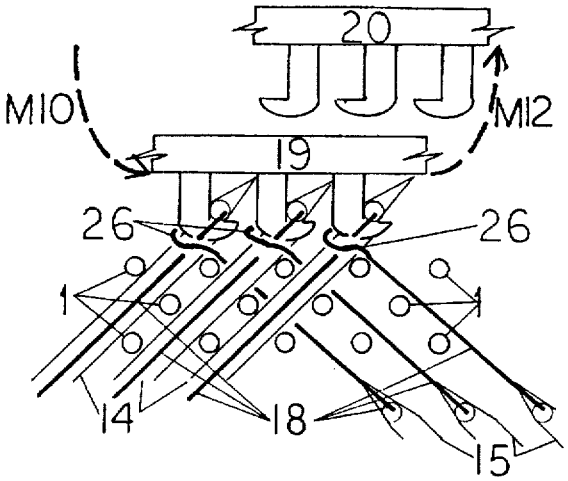
Figure 4E:
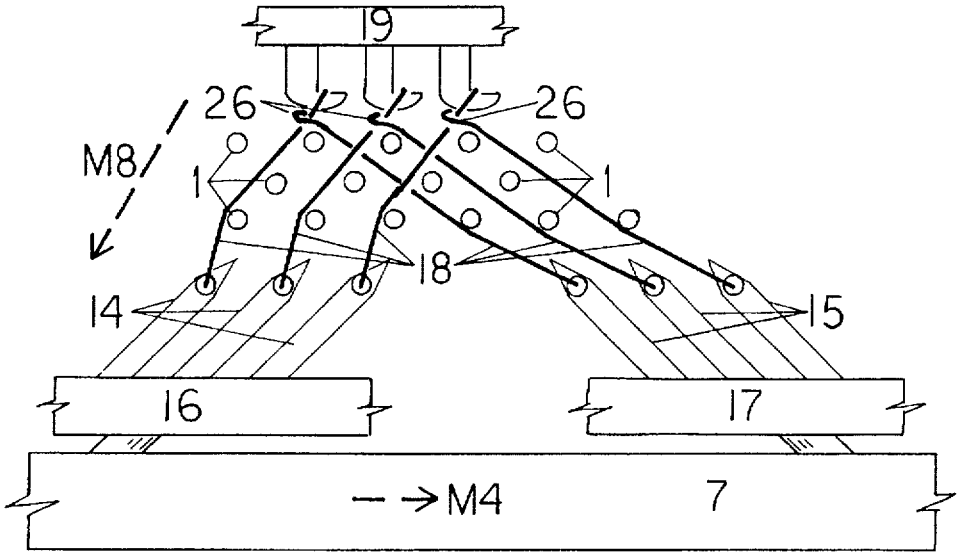

Similarly, FIG. 4D shows at the top of the stroke M7 o the +45° needles 14, the rear looper 20 retracting M12, releasing the old loops 26, and the front looper 19 extending M10 to catch each new loop of transverse yarn 18 held in the eye of each needle 14. Then, FIG. 4E shows the +45° needles retracting MP while the front looper 19 holds the "caught" loops 26.

It is pointed out that in the process just described above chained loop stitches were created at the top edge of the fabric. Specifically, in FIG. 4A when the –45° needles 15 stroked up M5 through the old loops 26 and when in FIG. 4B, the front looper 19 retracted M9 releasing the old loops 26, the old loops formed a chained loop stitch around the new loops of yarn 18 held in the eye of each –45° needle 15. Thus, the new row of transverse yarns 18 is chained to the preceding row of transverse yarns by their old loops 26.

Similarly, FIGS. 4C and 4D show the +45° needles 14 stroke up M7 through the old loops 26 and the rear looper 20 retracting M12, releasing its old loops 26 to form chained loop stitches around the new row of transverse yarns 18 held in the eyes of each +45° needle 14.

The next element described is the beat mechanism 10 shown in FIG. 2 that moves the longitudinal yarn guide plate 2 forward to compact the transverse yarns against the fell of the completed fabric 13. This beat mechanism is identical in configuration and function as the beat mechanism in embodiment 1.

The next element described is the shift mechanism 7 shown in FIG. 2 to shift both needle bars one yarn space to the right, or alternately, to the left. This alternate shift is shown as M4 in FIG. 2 and also in FIG. 4E. This shift mechanism is identical in configuration and function as the shift mechanism in embodiment 1.

A variety of take-up devices known to the art may be used in the practice of embodiment 2 of this invention to pull the completed fabric from the machine.

A variety of actuator devices known to the art may be used in the practice of embodiment 2 of this invention to actuate its various components.

A variety of loom control devices known to the art may be used in the practice of embodiment 2 of this invention to control the machine.

The maximum thickness of fabric that can be produced by embodiment 2 is the same as embodiment 1 because sewing needles can also be obtained a few inches in length.

The maximum speed of the embodiment 2 machine is not as fast as embodiment 1 because the extra step of extending and retracting the loopers must be placed in the sequence of actions performed by the machine. However, the motions of all components including the loopers are very short and therefore the embodiment 2 machine can also be made to operate very rapidly.

The maximum width of the fabric that can be produced by the embodiment 2 machine is constrained by the design width of the instant machine. There are no inherent limits on the width to which the embodiment 2 machine can be designed and thus transverse diagonal fabric several feet in width can be produced within the scope of embodiment 2 of this invention.

Fabric Pattern

Figure 5:
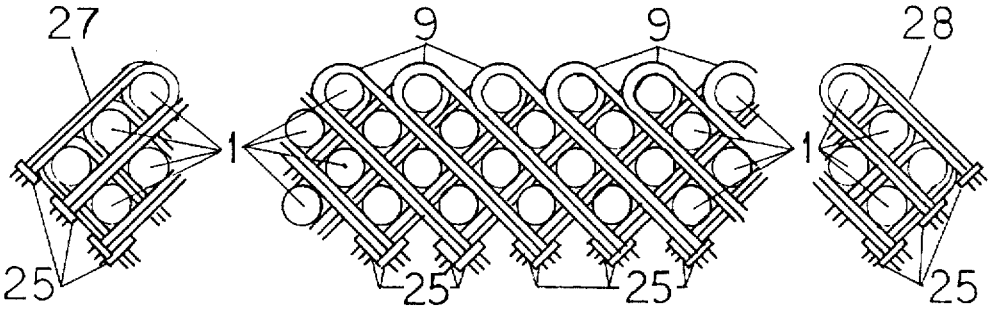
FIG. 5 shows the cross section pattern of the inventive transverse diagonal three-dimensional fabric.
Figure 6:
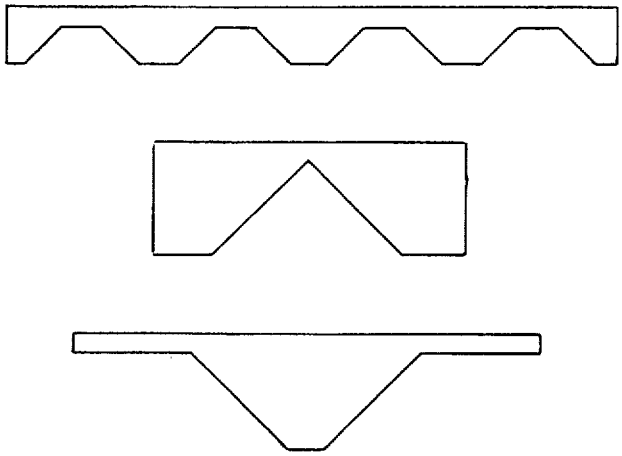
FIG. 6 shows some of the possible variations in the cross section shape of the inventive three-dimensional fabric.

The transverse diagonal three-dimensional fabric pattern produced by the above method and machine shall now be described. As shown in FIG. 5, this pattern consists of multiple rows or sheets of longitudinal yarns 1 in the longitudinal plane which are arranged in a diagonal pattern and are held straight, aligned with the longitudinal axis. The fabric also contains multiple rows of diagonal transverse yarns 9 inserted at +45° and –45° in the transverse plane orthogonal to themselves and to the longitudinal yarns. The transverse yarns are also held straight and in turn hold the longitudinal yarns straight, forming a dense interlocked fabric. Note that the transverse diagonal yarns replace the Y and Z yarns in the conventional X, Y, Z three-dimensional fabric pattern and therefore an entirely new fabric pattern is created. The fabric also contains chained loop stitches at the bottom edge of the panel of fabric in which each row of transverse yarns is chained to the preceding row of transverse yarns. It is noted that fabric produced by embodiment 2 of this invention has the chained loop stitches at the top edge of the panel of fabric. This orientation is of no consequence and the fabric produced by the two embodiments is identical. The outer most right and left transverse yarns pass around the exterior of the outer most longitudinal yarns which binds the right and left side edges of the panel of fabric. The fabric can be produced in variable cross sections. FIG. 6 shows some, but not all, of the possible cross section shapes in which this fabric can be produced.

I claim:

1. A transverse diagonal three-dimensional fabric pattern produced in flat panels that may be unrestricted in width, continuous in length, variable in thickness and variable in cross section shape; comprised of multiple rows of longitudinal yarns in the longitudinal plane of said fabric arranged in diagonal rows which are held straight, aligned with the longitudinal axis of said fabric; multiple rows of straight diagonal transverse yarns inserted at +45° and −45° in the transverse plane of said fabric between said longitudinal yarns orthogonal to themselves and to said longitudinal yarns; and chained loop stitches at the top or bottom edge of said panel of fabric; wherein the right and left side edges of said panel of fabric are bound by said transverse yarns.

2. A method for rapidly producing the transverse diagonal three-dimensional fabric according to claim 1, comprised of the following steps:

(a) positioning said multiple rows of straight longitudinal yarns in the longitudinal plane of said fabric arranged in said diagonal pattern of the fabric, (b) inserting said multiple rows of straight diagonal transverse yarns at said +45° and −45° in the transverse plane of said fabric, orthogonal to themselves and to said longitudinal yarns, (c) forming said chained loop stitches at the top or bottom edges of said panel of fabric wherein each row of said diagonal transverse yarns is chained to the preceding row of said diagonal transverse yarns, (d) compacting said diagonal transverse yarns into the completed form of said fabric pattern, and (e) binding the right and left side edges of said panel of fabric with said transverse yarns.

3. A machine to implement the method of claim 2 to rapidly produce the transverse diagonal three-dimensional fabric according to claim 1, comprised of the following components:

(a) a longitudinal yarn guide device to align said multiple rows of straight longitudinal yarns in the longitudinal plane of said fabric arranged in said diagonal pattern of the fabric, (b) two needle bar assemblies, including needle means mounted at said +45° and 45°, including means for inserting said multiple rows of straight diagonal transverse yarns in the transverse plane of said fabric at +45° and −45° between said longitudinal yarns and including means for forming said chained loop stitches at the bottom edge of said panel of fabric, (c) a beat mechanism for moving said longitudinal yarn guide device against the fell of said completed fabric to compact or beat said diagonal transverse yarns, and (d) a shift mechanism for shifting both said needle bar assemblies alternately one yarn space to the right and to the left including means to bind the right and left side edges of said panel of fabric.

4. The machine of claim 3 wherein the needle means are knitting needles.

5. The machine of claim 3 wherein the needle means are sewing needles.

* * * * *